US006325068B1

(12) United States Patent
Dombek et al.

(10) Patent No.: US 6,325,068 B1
(45) Date of Patent: Dec. 4, 2001

(54) METHOD OF AND APPARATUS FOR TREATING WEBS OF WRAPPING MATERIAL

(75) Inventors: Manfred Dombek, Dassendorf; Helmut Voss, Lokstedt, both of (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 09/325,426

(22) Filed: Jun. 4, 1999

(30) Foreign Application Priority Data

Jun. 4, 1998 (DE) ..... 198 24 849

(51) Int. Cl.[7] ..... B23K 26/00

(52) U.S. Cl. ..... 131/281; 131/280; 219/121.7; 219/121.71; 219/121.76; 219/121.72

(58) Field of Search ..... 131/281, 29, 35, 131/37, 57.5, 61.1, 71, 76, 88, 90, 93, 95, 280, 284; 219/121.67, 121.7, 121.71, 121.76, 121.72

(56) References Cited

U.S. PATENT DOCUMENTS 4,281,670 8/1981 Heitmann et al. .

6,064,032 * 5/2000 Voss et al. ..... 219/121.67

FOREIGN PATENT DOCUMENTS

WO 88/03897 * 6/1988 (WO) .

* cited by examiner

*Primary Examiner*—Stanley S. Silverman
*Assistant Examiner*—Dionne A. Walls
(74) *Attorney, Agent, or Firm*—Venable; Robert Kinberg

(57) ABSTRACT

An elongated strip of tipping paper is advanced in a tipping machine for the making of filter cigarettes. The strip advances past a perforating unit and thereupon past a cutting unit which subdivides the perforated strip into a series of uniting bands ready to be convoluted around abutting ends of plain cigarettes and filter rod sections. One side of the strip is coated with a film of an adhesive which can be inactivated by exposing it to coherent radiation. The perforating and cutting steps are carried out by one or two beams of coherent radiation which can further serve to inactivate the adhesive around each perforation and along the edges which extend across the strip to thus reduce the likelihood of penetration of active adhesive into the perforations and/or a contamination of the products by active adhesive being expelled beyond the marginal portions of the uniting bands. A single source can suffice to furnish coherent radiation for the carrying out of the perforating, cutting and inactivating operations.

14 Claims, 4 Drawing Sheets

METHOD OF AND APPARATUS FOR TREATING WEBS OF WRAPPING MATERIAL

CROSS-REFERENCE TO RELATED CASES

This application claims the priority of German patent application Serial No. 198 24 849.0 filed Jun. 4, 1998. The disclosure of the German patent application, as well as that of each U.S. and foreign patent and patent application mentioned in the specification of the present application, is incorporated herein by reference.

BACKGROUND OF THE INVENTION

The invention relates to improvements in methods of an apparatus for treating elongated flexible laminates of the type having an elongated web of paper, artificial cork or the like and a film of an adhesive at least partially coating one side of the web. Laminates of such character can be utilized with advantage in so-called filter tipping machines for the making of filter cigarettes, cigarillos, cigars or the like (hereinafter referred to as filter cigarettes).

It is customary to make filter cigarettes by placing plain cigarettes of a unit length or multiple unit length end-to-end with rod sections (i.e., with filter plugs or filter muthpieces) for tobacco smoke, and by thereupon convoluting discrete adhesive-coated uniting bands around the abutting ends and the neighboring portions of the thus assembled pairs of rod-shaped constituents of filter cigarettes.

It is also customary to enhance the permeability of adhesive-coated uniting bands prior or subsequent to draping of such uniting bands around the pairs of coaxial rod-shaped components of filter cigarettes. This normally involves the making of perforations in the convoluted uniting bands or in the laminate which is to be subdivided into a series of discrete uniting bands. An advantage of such perforations is that the column of tobacco smoke flowing from the lighted end of a filter cigarette into the lungs of a smoker is mixed with relatively cool atmospheric air which is being drawn through the perforations. This is believed to be beneficial to the smoker. Reference may be had, for example, to U.S. Pat. No. 4,281,670 granted Aug. 4, 1981 to Uwe Heitmann et al. for "APPARATUS FOR INCREASING THE PERMEABILITY OF WRAPPING MATERIAL FOR ROD-SHAPED SMOKERS' PRODUCTS". This patent shows and describes perforating apparatus which are designed to make perforations in a running strip of uncoated tipping paper as well as apparatus for the making of holes in discrete uniting bands which are already convoluted around pairs of coaxial rod-shaped products, e.g., around the abutting ends of coaxial plain cigarettes and filter mouthpieces of unit length or multiple unit length.

In order to ensure reliable and predictable adherence of a convoluted uniting band to the adjacent portions of cigarette paper surrounding a plain cigarette as well as to the adjacent portions of the wrapper of a filter mouthpiece, one side of the running web of tipping paper or the like is coated with a suitable adhesive, e.g., shortly or immediately upstream of the perforating station or immediately following the perforating step and prior to subdivision of the perforated and adhesive-coated web into a series of discrete uniting bands. It is advisable to avoid the application of adhesive to those portions of a perforated web of tipping paper which are immediately adjacent the perforations and/or the transversely extending strip-shaped zones flanking the locations where the web is being subdivided into discrete uniting bands because this reduces the likelihood of clogging the perforations with activated adhesive and/or of contamination of the regions of overlap of marginal portions of convoluted uniting bands. A clogging of the perforations with an activated adhesive defeats the purpose of the perforations, and contamination of the overlapping marginal portions of convoluted adhesive-coated uniting bands detracts from the appearance of filter cigarettes.

Furthermore, the application of adhesive to one side of a running web of tipping paper in such a way that the regions immediately surrounding the perforations and the regions adjacent the severed zones of the running web are not coated with adhesive contributes significantly to the cost of the adhesive applying apparatus. Thus, the controls for the adhesive applicator are complex and expensive; in addition, such apparatus cannot always ensure the establishment of adhesive-free regions at the perforations and at the loci of subdivision of the web into discrete uniting bands.

OBJECTS OF THE INVENTION

An object of the invention is to provide a novel and improved method of preventing the adhesive from clogging the holes and from contaminating the overlapping marginal portions of uniting bands, particularly of uniting bands for use in filter tipping and analogous machines.

Another object of the invention is to provide a method which renders it possible to simplify the application of adhesive to a running web of tipping paper or the like.

A further object of the invention is to provide a novel and improved apparatus for the practice of the above outlined method.

An additional object of the invention is to provide novel and improved uniting bands for use in filter tipping machines.

Still another object of the invention is to provide a combined adhesive applying and influencing as well as web severing apparatus which can be utilized in a filter tipping machine as a superior substitute for heretofore known apparatus.

A further object of the invention is to provide a novel and improved method of treating the adhesive subsequent to its application to a running web of tipping paper, particularly in a machine for the making of filter cigaretes or the like.

Another object of the invention is to provide novel and improved filter cigarettes.

An additional object of the invention is to provide a novel and improved combination of one or more sources of coherent radiation and optical elements for use in an apparatus of the above outlined character.

SUMMARY OF THE INVENTION

One feature of the invention resides in the provision of a method of treating a laminate including a web (e.g., a web of paper or artificial cork) and a film of an inactivatable adhesive which at least partially coats at least one side of the web. The improved method comprises the steps of (a) severing at least one first portion of the laminate to thus provide one or more perforations and/or slits extending all the way between the one side and the other side of the laminate, and (b) inactivating the adhesive forming part of at least one second portion of the laminate, particulary of that (second) portion or those (second) portions of the laminate which surrounds or surround the severed portion (s).

In accordance with a presently preferred embodiment of the invention, the adhesive film coats at least a major a portion of the one side (most preferably the entire one side) of the web. This simplifies the application of the adhesive film.

If the laminate is a strip of tipping paper for use in a so-called filter tipping machine which is used to assemble plain cigarettes and filter rod sections into filter cigarettes, such strip consists of a series of coherent uniting bands adapted to be convoluted around abutting ends and around the adjacent portions of plain cigarettes and filter rod sections. The method of treating such laminate preferably further comprises the step of advancing the laminate in a predetermined. direction along a predetermined path, and the severing step includes repeatedly cutting across the advancing web in a predetermined portion of the path (particularly in a path portion which is defined by the peripheral surface of a roller or an analogous rotary member) to thus separate successive uniting bands of the series from the advancing laminate. The thus separated uniting bands are ready to be attached to and thereupon convoluted around abutting end portions of a plain cigarette and a fiter mouthpiece or around the end portions of two coaxial plain cigarettes and the entire filter mouthpiece between them.

In accordance with a preferred embodiment of the instant invention, the adhesive is inactivatable in response to exposure to coherent radiation issuing from one or more lasers or analogous sources, and the cutting, too, is carried out by subjecting selected portions of the advancing laminate to the action of one or more beams of coherent radiation. The aforementioned cutting step then comprises establishing a source of coherent radiation and directing at least one first beam of coherent radiation from the source against longitudinally spaced-apart transversely extending regions of the laminate in the predetermined portion of the path to thus separate the successive uniting bands from the leading end of the advancing laminate. The inactivating step can include directing at least one beam of coherent radiation from the source against the adhesive film adjacent the aforementioned transversely extending regions. Such inactivating step can be carried out prior to or simutaneously with the cutting step. The result of the inactivating step is that each uniting band has one or two marginal sections of inactivated adhesive.

In addition to or in lieu of the aforementioned cutting step, the severing step can comprise providing the web with a plurality of perforations each of which is at least partially surrouded by adhesive, and the inactivating step then includes inactivating the adhesive around at least some of. the perforations.

If the adhesive is inactivatable in response to exposure to coherent radiation, the method can be practiced in the following way: The severing step can include establishing at least one source of coherent radiation and repeatedly directing at least one first portion of a beam of coherent radiation issuing from the at least one source against selected sections of the at least one first portion of the laminate to thus provide the laminate with the aforementioned perforations, and the inactivating step can comprise simultaneously directing at least one second portion of the at least one beam against the adhesive surrounding at least some of the perforations so that such perforations are surrounded by regions of inactivated adhesive.

It will be seen that, if the adhesive is inactivatable in response to exposure to coherent radiation, one side of the strip (i.e., one layer) of the laminate can be provided with a film (i.e., with the other layer) of such adhesive in its entirety which simplifies the adhesive applying step, and the inactivating step thereupon involves directing coherent radiation against those portions of the film which flank the locations of future cuts and/or which surround at least some of the perforations or the loci of future perforations. The severing step (regardless of whether it involves cutting of the laminate into discrete uniting bands and/or the making of perforations) can be carried out by resorting to coherent radiation, namely to a beam of radiation issuing from that source of radiation which is utilized to inactivate selected portions of the film, to a beam of coherent radiation issuing from one or more discrete second sources, or by utilizing a single beam a first portion of which is utilized to sever (cut and/or perforate) the laminate and a second portion of which is utilized to inactivate the adhesive around the (freshly made or future) perforations and/or to inactivate the adhesive around some or all of the (existing or about to be made) cuts.

The adhesive can contain one or more solvents which is or are evaporable in response to the action of coherent radiation to thus inactivate the corresponding part or parts of the adhesive film, and the inactivating step can include subjecting the solvent(s) in the adhesive forming part of the selected portion or portions of the adhesive film to the action of coherent radiation. It is equally within the purview of the invention to inactivate one or more portions of the already applied film of adhesive containing one or more evaporatable solvents by causing a partial or complete evaporation of such solvent or solvents from one or more selected portions of the applied adhesive film by resorting to an expedient other than contacting one or more selected portions of the film by coherent radiation. The same holds true if the inactivation involves evaporation of entire portions of the adhesive film from selected portions of the first layer (such as tipping paper) of the laminate.

In accordance with another presently preferred embodiment of the improved method, which can be practiced if the adhesive is inactivatable in response to exposure to coherent radiation, the severing step comprises establishing at least one source of coherent radiation, directing from the at least one source a first portion of at least one beam of coherent radiation against predetermined sections of the at least one first portion of the laminate to thus provide the laminate with a plurality of perforations, as well as with a plurality of elongated cuts dividing the laminate into a plurality of discrete bands (such as uniting bands which are utilized in a filter tipping machine), and the inactivating step comprises directing a second portion of the at least one beam against the adhesive surrounding the perforations and/or against the adhesive film portions flanking the cuts so that the perforations are surrounded and/or the cuts are flanked by inactivated adhesive.

The intensity of the second portion of the at least one beam of coherent radiation is or can be a minute fraction of the intensity of such beam (e.g., approximately ten percent of the intensity of the beam.

Another feature of the invention resides in the provision of an apparatus for treating a laminate including a web (e.g., a web of tippping paper or the like), and a film of inactivatable adhesive which at least partially coats at least one side of the web. The apparatus comprises means for severing (particularly perforating and/or cutting) at least one first portion of the laminate, and means for inactivating at least a portion of the adhesive subsequent to application of such film to one side of the substrate (i.e., to one side of the web which carries the adhesive film).

As already mentioned hereinbefore, the severing step can comprise providing the laminate with perforations and/or repeatedly cutting the laminate to convert it into a series of uniting bands ready to be convoluted around abutting end portions of rod-shaped smokers' products, e.g., around end portions of plain cigarettes and around end portions of filter mouthpieces which are coaxial with and abut the adjacent end portions of the plain cigarettes.

The apparatus normally further comprises means (such as a plurality of suction drums) for advancing the laminate (strip of tipping paper) in a predetermined direction along a predetermined path (e.g., in a filter tipping machine). The severing means and/or the inactivating means is adjacent a first portion of the predetermined path, and the apparatus can further comprise means for applying (e.g., spraying or brushing) the adhesive to at least one side of the web in a second portion of the path upstream of the first portion.

If the adhesive is inactivatable in response to exposure to coherent radiation, the inactivating means can comprise at least one source of coherent radiation and means for directing at least one beam of coherent radiation from the at least one source against one or more selected portions of the film (either directly, i.e., by directing the beam against the adhesive-coated portion of the laminate, or indirectly by directing the beam against the uncoated surface of the web).

If the severing means comprises or constitutes a means for cutting the laminate for the purpose of forming a succession of discrete uniting bands, such severing means can comprise at least one source of coherent radiation and means for repeatedly directing at least one beam of coherent radiation from the at least one source against and transversely across the laminate in a predetermined portion of the path of lengthwise movement of the laminate. Such at least one beam, or a discrete second beam, can be utilized to inactivate one or more portions or sections of the adhesive film, for example, at both sides of each location where the laminate is being severed or is to be severed to yield a succession of discrete uniting bands. Thus, each uniting band can comprise one marginal portion or two discrete marginal portions which are coated with inactivated adhesive or which are devoid of adhesive if the inactivating step involves evaporation of the entire adhesive film from predetermined portion or portions of the web.

If the laminate is to be provided with perforations (e.g., with one or more longitudinally extending rows of equidistant perforations in addition to or in lieu of making the aforementioned transverse cuts), the severing means can comprise at least one source of coherent radiation (such as the source which furnishes radiation for the making of transverse cuts) and means for directing at least one beam of coherent radiation from such source against selected portions of the laminate. The characteristics of the beam and of the means for repeatedly directing the beam against the laminate are selected in such a way that the laminate is provided with perforations of a desired size and shape.

In accordance with one presently preferred embodiment, the improved apparatus comprises a single source of coherent radiation and the aforementioned advancing means (in addition to the afore discussed severing and inactivating means). The severing means of such apparatus can comprise means for repeatedly directing at least one beam of coherent radiation from the single source against the laminate in a predetermined portion of the path which is defined by the advancing means to thus provide the laminate with a series of longitudinally spaced-apart transverse cuts each of which is surrounded by adhesive at one side of the web, and the severing means can further comprise means for repeatedly directing at least one beam of coherent radiation from the single source against selected portions of the advancing laminate to provide the laminate with at least one group of perforations (e.g., with at least one longitudinally extending row of equidistant perforations) each of which is surrounded by adhesive. If the adhesive is inactivatable in response to exposure to coherent radiation, the inactivating means can comprise means for directing at least one beam of coherent radiation from the single source against the film of adhesive around each perforation and/or along the cuts.

If at least one of the severing and inactivating means includes at least one source of coherent radiation, the severing and/or the inactivating means can further comprise means for directing at least one beam of coherent radiation from the at least one source against the laminate. Such means for directing can include a diffractive optical element which is arranged to direct a higher-intensity portion of the at least one beam against the laminate to thus sever the laminate, and to direct a lower-intensity portion of the at least one beam against the film of adhesive to thus inactivate certain selected portion or portions of the adhesive film.

The selection of the intensities can be such that the higher-intensity portion of the at least one beam takes up approximately one-third of the cross-sectional area of the beam. The lower-intensity portion can surround the higher-intensity portion of the at least one beam. The intensity of the higher-intensity portion of the at least one beam can be selected in such a way that it matches or approximates about 90% of the total intensity of the beam.

The novel features which are considered as characteristic of the invention are set forth in particular in the appended claims. The improved apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
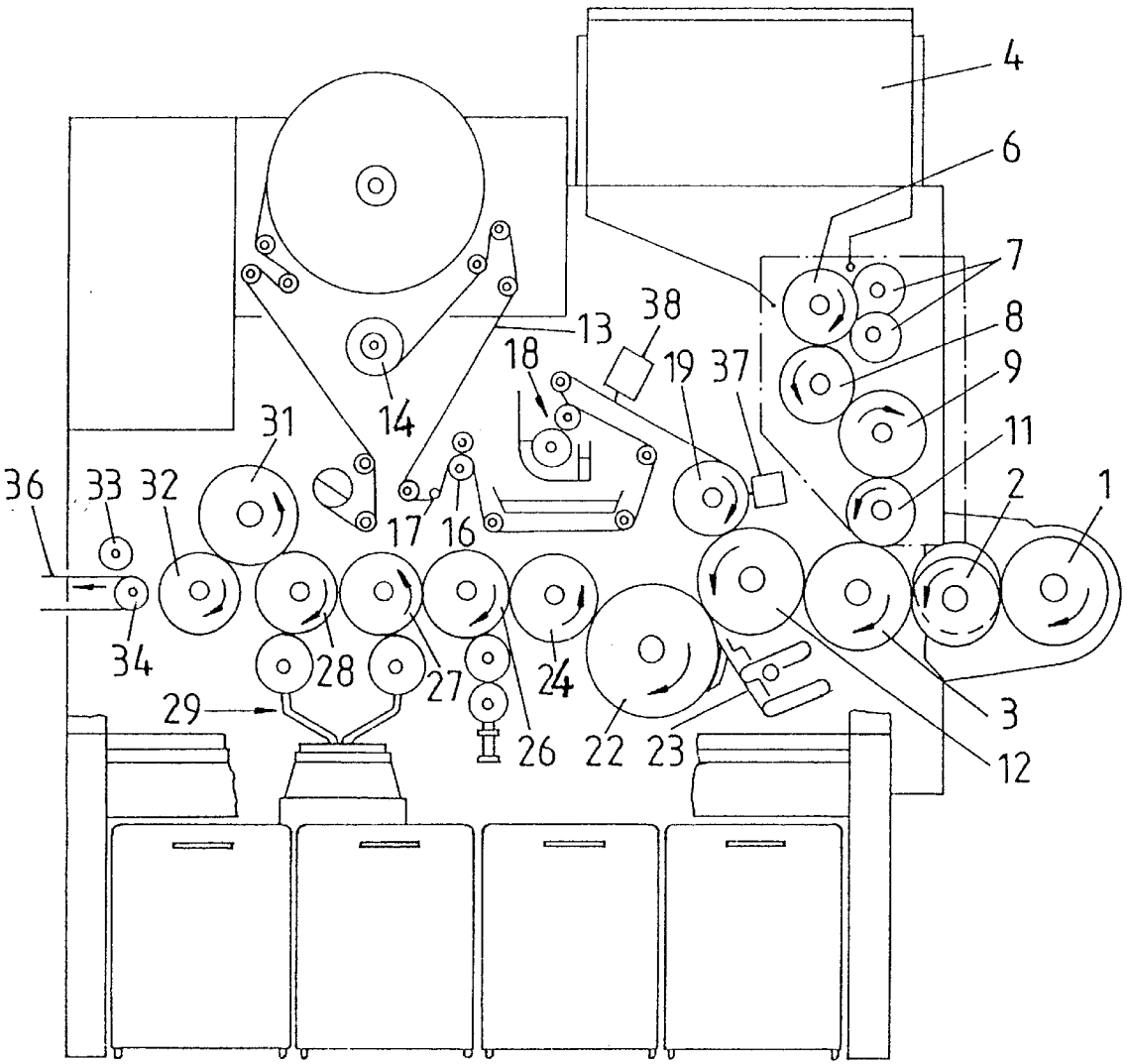
FIG. 1 is a schematic front elevational view of a filter tipping machine including an apparatus which embodies one form of the invention.

FIG. 1 illustrates certain details of a filter tipping machine of the type known as MAX which is distributed by the assignee of the present application. This machine employs an apparatus which embodies one form of the present invention, namely an embodiment which is shown in and will be fully described with reference to FIGS. 2, 3, 4 and 5. In all, or practically all, other respects, the filter tipping machine of FIG. 1 is or can be identical with the machine shown in FIG. 1 of the aforementioned U.S. Pat. No. 4,281,670 to Heitmann et al.

The reference character 1 denotes in FIG. 1 a rotary drum-shaped conveyor having peripheral flutes for two rows of a plain cigarettes of unit length supplied by a suitable cigarette rod making machine, e.g., a machine of the type shown in FIG. 7 of the aforementioned patent to Heitmann et al. The cigarettes of one of the rows are staggered relative to the cigarettes of the other row, as seen in the circumferential direction of the conveyor 1. The latter delivers the cigarettes to an aligning unit 2 including two discrete rotary drum-shaped conveyors each of which receives one row of cigarettes from the conveyor 1. The conveyors of the unit 2 are set up to transport the respective plain cigarettes of unit length at different speeds and/or through different distances so as to transfer into successive axially parallel flutes of a rotary drum-shaped assembly conveyor 3 pairs of coaxial plain cigarettes of a unit length in such a way that the plain cigarettes of each pair are spaced apart from each other (in the axial direction of the assembly conveyor 3) through distances preferably at least slightly exceeding the length of a rod-shaped filter plug or filter mouthpiece of double unit length.

The top portion of the machine frame supports a magazine 4 for a supply of filter rod sections of six times the unit length. Such sections are fed into succesive axially parallel peripheral flutes of a rotary drum-shaped severing conveyor 6 which transports the sections past two axially and circumferentially staggered rotary disc-shaped knives 7 serving to subdivide each section of six times the unit length into three coaxial sections of a double unit length. The conveyor 6 delivers sets or groups of three coaxial filter rod sections of a double unit length to the periphery of a rotary staggering conveyor 8 which staggers the sections of successive groups in a circumferential direction and delivers discrete sections of double unit length into successive peripheral flutes of a rotary drum-shaped shuffling conveyor 9 which converts the sections into a single file wherein each section of a double unit length is in alignment with the preceding and next following sections. Successive sections of the thus obtained file are delivered to a rotary drum-shaped accelerating conveyor 11 which which increases the speed of the sections delivered by the shuffling conveyor 9 to the peripheral speed of the assembly conveyor 3. Each of the aforementioned clearances or gaps between the pairs of aligned plain cigarettes of a unit length on the assembly conveyor 3 receives a filter rod section of a double unit length so that those flutes of the conveyor 3 which advance beyond the transfer station between the conveyors 3 and 11 carry groups of three coaxial rod-shaped components, namely a pair of plain cigarettes of the unit length and a filter mouthpiece of the double unit length between them.

The magazine 4 receives filter rod sections of six times the unit length from a suitable filter rod making machine (e.g., a machine known as KDF which is distributed by the assignee of the present application).

The frame of the filter tipping machine further comprises means for supporting two reels containing supplies of convoluted webs 13 of tipping paper (e.g., cigarette paper or artificial cork). The expiring reel 14 supplies a web 13 of tipping paper into the range of a so-called curling device 17 located upstream of a set of web advancing rollers 16. A combined severing and advancing suction drum 19 cooperates with a set of idler rollers (shown but not referenced in FIG. 1) to define an elongated path for advancement of the web 13 from the driven advancing rollers 16 past the perforating unit 38 and thereupon into the range of the cutting or subdividing unit 37. An adhesive applying unit 18 upstream of the perforating unit 38 serves to provide one side of the running web 13 with a film of a suitable adhesive and to thus form a twin-layer laminate wherein one of the layers is constituted by the web 13 of tipping paper and the other layer is constituted by the adhesive film. The leading end of the laminate is repeatedly cut in the axial direction of the drum 19 so that the laminate yields a series of successive uniting bands which are ready to contact successive groups of coaxial components being supplied by the assembly conveyor 3 to the axially parallel flutes at the periphery of a rotary drum-shaped transfer conveyor 12.

The aforementioned groups of three coaxial components each are shortened (on the assembly conveyor 3 or on the transfer conveyor 12 upstream of the transfer station between the conveyors 19 and 12) so that one end face of each of the two plain cigarettes abuts the adjacent end face of the filter rod section of double unit length between them before such groups receive discrete uniting bands from the conveyor 19. Each uniting band extends tangentially of the respective group and is in more or less linear contact with the filter rod section of a double unit length as well as with the adjacent portions of the two plain cigarettes. Such groups (each of which carries a uniting band) are transferred onto the periphery of a rotary drum-shaped rolling or convoluting conveyor 22 cooperating with a so-called rolling member or rolling hand 23 to convolute the uniting band around the respective filter rod section of double unit length and the adjacent inner end portions of the plain cigarettes and to thus convert each group into a filter cigarette of a double unit length.

Succesive filter cigarettes of a double unit length are transferred onto a rotary drum-shaped drying conveyor 24 which promotes the setting of the adhesive before the groups are delivered to the periphery of a rotary drum-shaped severing conveyor 26 cooperating with a rotary disc-shaped circular knife to sever each filter cigarette of a double unit length midway across its convoluted uniting band so that each such filter cigarette yields two filter cigarettes of a unit length, each having a filter plug or filter mouthpiece of unit length adjacent the filter mouthpiece of the other filter cigarette of unit length.

Succesive pairs of filter cigarettes of a unit length are delivered to a rotary drum-shaped transfer conveyor 27 forming part of a conventional turn-around device 29 which further includes a rotary drum-shaped combined gathering and discharging conveyor 28. The purpose of the turn-around device 29 is to invert one filter cigarette of each pair delivered by the severing conveyor 26 (so that the mouthpieces of all cigarettes face in the same direction) and to deliver the inverted cigarettes to the periphery of the conveyor 28 in such a way that the inverted and non-inverted filter cigarettes of unit length form a single row of aligned cigarettes which are advanced sideways from the conveyor 28 onto a testing conveyor 31. The latter comprises or cooperates with means for monitoring the characteristics of each filter cigarette, for example, to detect blemishes on the wrappers of such cigarettes, the presence of improperly convoluted uniting bands, open seams on the plain cigarettes and/or others. Defective articles are ejected by a rotary drum-shaped conveyor 32 which receives tested cigarettes from the conveyor 31. Certain defective cigarettes can be detected and ejected as early as on the severing conveyor 26. Furthermore, one or more testing operations can be carried out on the ejecting conveyor 32; for example, this conveyor can comprise or cooperate with means for monitoring the density of the tobacco-containing ends of the filter cigarettes of a unit length.

The conveyor 32 delivers satisfactory filter cigarettes of a unit length onto the upper reach of a belt conveyor 36 which is trained over two or more pulleys 34 (only one shown in FIG. 1) and cooperates with a braking roller 33. The conveyor 36 can deliver satisfactory filter cigarettes of unit length to a packing machine, into storage or to another destination.

Figure 2:
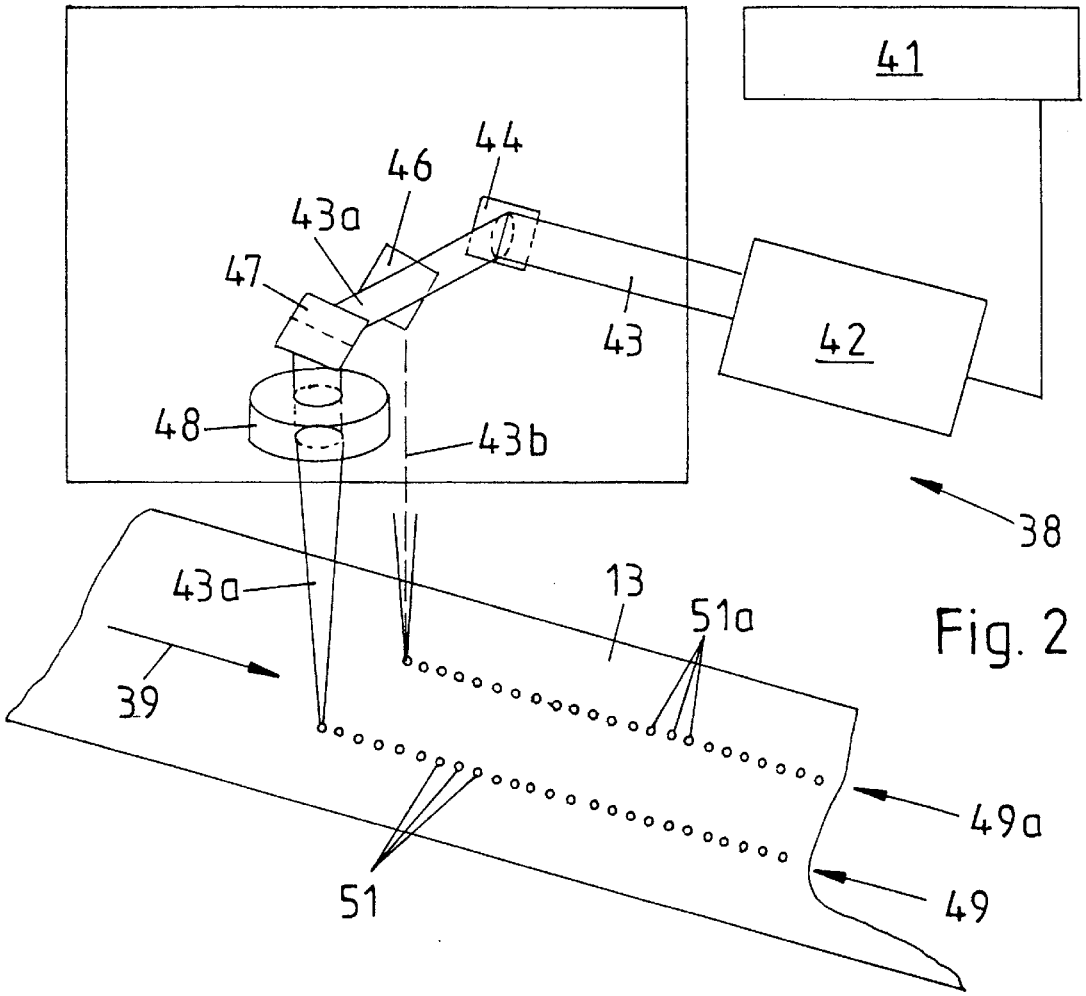
FIG. 2 is a partly diagrammatic and partly perspective view of an apparatus which can be utilized in the machine of FIG. 1 and includes a severing unit serving to make two rows of perforations in a running elongated strip-shaped laminate which is to be subdivided into discrete uniting bands.

FIG. 2 shows the details of a perforating unit 38 which can be utilized as part of the severing unit in the machine of FIG. 1. The severing unit further includes the cutting unit 37 of FIG. 1, e.g., a cutting unit of the type shown in FIG. 3. The parts of the perforating unit 38 of FIG. 2 are shown schematically and are not drawn to scale. The same applies for the cutting unit 37 of FIG. 3.

The perforating unit 38 is designed to provide the laminate (i.e., the adhesive-coated web 13) with a predetermined array of perforations, namely with two rows of equidistant perforations 51 and 51*a*. The two rows extend longitudinally of the laminate and are parallel with the marginal portions of the web 13. The parts of the unit 38 include a source 42 of coherent radiation (hereinafter called laser for short) and a regulating circuit 41 which controls the operation of the laser. The latter emits a beam 43 of coherent radiation which impinges upon a reflecting and deflecting mirror 44. The thus deflected single beam 43 impinges upon a partially transmitting mirror 46 and is thus divided into a first partial beam 43*a* (namely coherent radiation which has penetrated through the mirror 46) and a second partial beam 43*b* (namely that portion of the beam 43 which has been deflected by the mirror 46). It is assumed that the mirror 46 is designed to divide the beam 43 into two identical split beams or partial beams 43*a*, 43*b*.

The partial beam 43*a* is fully deflected by a mirror 47 so that it impinges upon and is influenced by an optical system 48 including a two-stage diffractive lens. A similar optical system (not shown in FIG. 2) is installed in the path of propagation of the partial beam 43*b* which is deflected by the mirror 46. The control unit 41 and the optical system 48 cooperate to cause the split beam 43*a* to repeatedly impinge upon the laminate including the web 13 (while the laminate is being pulled by the advancing conveyor 19 to proceed in the direction indicated by the arrow 39) and to thus provide the laminate with a row 49 of equidistant and preferably round perforations 51. The manner in which the non-illustrated optical system (which is or can be identical with the optical system 48) cooperates with the control unit 41 to repeatedly focus the split or partial beam 43*b* upon the advancing laminate and to thus provide the laminate with a row 49*a* of equidistant perforations 51*a* is the same as described above in connection with the making of the row 49.

Figure 5:
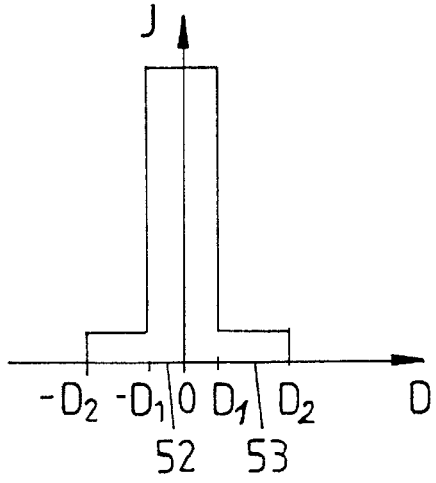
FIG. 5 illustrates the intensity profile of a beam of coherent radiation which can be utilized in the apparatus of the present invention to simultaneously sever the web and inactivate selected portions of the adhesive film.

The intensity profile of the two-stage diffractive lens of the optical element 48 in the perforating unit 38 of FIG. 2 is illustrated in FIG. 5. The intensity J of coherent radiation (partial beam 43*a*) is measured along the ordinate, and the distance D from the optical axis of the lens in the focal plane (i.e., in the plane of the advancing laminate including the web 13 and the adhesive film at one side of the web, namely at the upper side of the web as seen in FIG. 2) is measured along the abscissa. The diagram of FIG. 5 is characteristic of the design of each of the two lenses 48 which are utilized in the perforating unit 38 of FIG. 2. As can be seen, the beam 43*a* or 43*b* has a higher-intensity circular central portion or section 52 with a radius $D_1$, and an annular lower-intensity portion or section 53 which surrounds the central portion 52 and has a radially outermost portion with a radius $D_2$. The intensity of the central portion corresponds to approximately 90% of the radiation output of the beam portion 43*a* or 43*b*, and the remaining 10% of overall intensity is that which influences the adhesive film within the annular area surrounding the circular central area with the radius $D_2$. The ratio of the diameter $2D_2$ to the diameter $2D_1$ is or can closely approximate 3:1.

Figure 4:
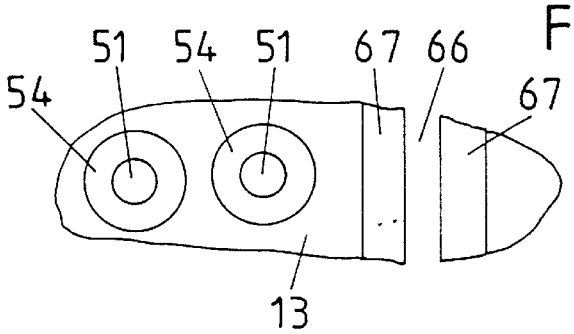
FIG. 4 is an enlarged view of a detail within the dot-dash line circle IV shown in FIG. 3.

As can be seen in FIG. 4, that portion of the beam 43*a* which impinges upon the running laminate including the web 13 at the central field 52 is used to make the perforations 51, and the remaining portion of the beam 43*a* is used to inactivate the annular area 54 surrounding the respective perforation 51. The inactivating action of the aforementioned remaining portion of the beam 43*a* can amount to evaporation of adhesive from the respective annular portion of the web 13 or to evaporation of one or more solvents from the freshly applied adhesive film. Thus, in lieu of resorting to a highly complicated adhesive applicator, the improved apparatus can employ a rather simple paster 18 which is arranged to coat the entire upper side of the web 13 during advancement of successive increments of the web in a direction from the driven advancing means 16 past the applicator 18.

As used herein, the term "inactivate" is intended to denote expulsion of one or more ingredients from the adhesive film which coats the annular portions or sections 54 of the web 12, as well as complete evaporation of the annular portions of adhesive film overlying the web sections 54.

An advantage of inactivation of adhesive which was applied to the annular sections 54 of the web is that the adhesive is much less likely to flow radially inwardly from the region surrounding an annular section 54, across the section 54 and into the respective perforation 51. In other words, the adhesive which was applied at 18 and was partially inactivated at 38 is highly unlikely to influence the quantity of air which flows through the perforations 51 and into a smoker's mouth when the respective filter cigarette is lighted.

Of course, the energy of the annular field 53 which surrounds the central field 52 should be selected with a view to avoid charring and/or any other undesirable influencing of the convoluted uniting bands on the finished filter cigarettes.

Figure 3:
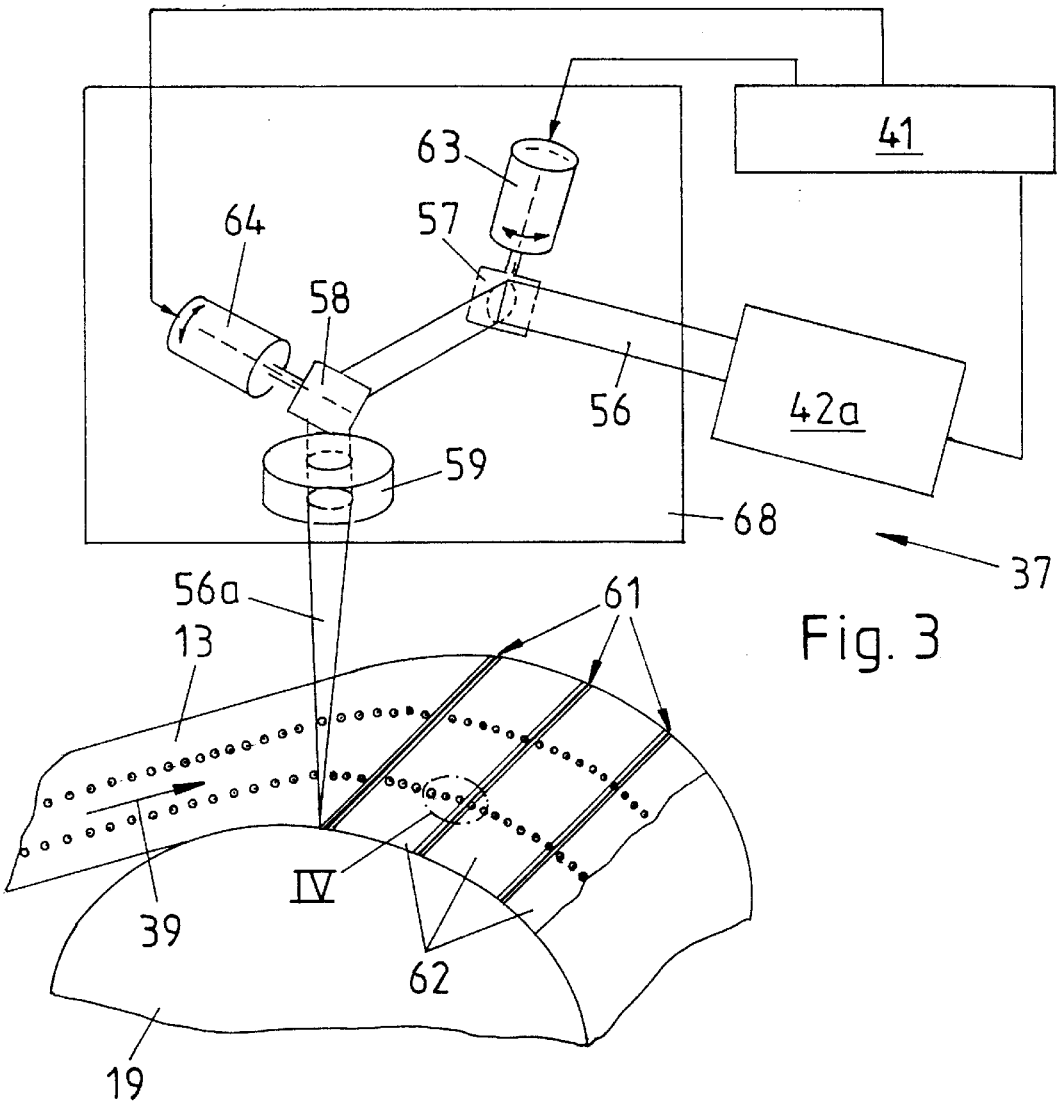
FIG. 3 is a fragmentary partly diagrammatic and partly perspective view of that part of a severing unit which can be utilized to subdivide the preperaforated laminate into a succession of discrete uniting bands.

FIG. 3 shows all relevant details of the cutting apparatus 37 which is utilized in the filter tipping machine of FIG. 1 to repeatedly sever the leader of the advancing laminate at the periphery of the rotary drum-shaped conveyor 19. The latter can constitute a customary suction conveyor having a peripheral surface provided with suction ports connected to a suction generating device (e.g., a pump) while the ports advance from the twelve or one o'clock position to the five or six o'clock position (as viewed in FIG. 1). The apparatus 37 comprises a laser 42*a* connected to the aforementioned control circuit 41 (or to a discrete control circuit other than the circuit 41 for the laser 42) and arranged to emit a beam 56 of coherent radiation which is deflected by a fully reflecting mirror 57 to impinge upon a further fully reflecting mirror 58. The latter directs the beam 56 upon an optical system 59 which comprises a two-stage diffractive lens 59 serving to repeatedly focus the beam 56a upon the advancing leader of the laminate including the perforated web 13. The optical arrangement 68 including the mirrors 57, 58 and the lens 59 is set up in such a way that the beam 56a cuts the laminate in parallelism with the axis of the conveyor 19 to thus provide the leader of the advancing laminate (see the arrow 39) with transversely extending straight cuts 61 across trailing ends of successive uniting bands 62 and the leader of the laminate.

The control unit 41 of FIG. 3 cooperates with two oscillators 63, 64 which respectively serve to oscillate the mirrors 57 and 58 in order to ensure that the cuts 61 are equidistant from each other and that the cuts are straight and extend all the way between and across the two marginal portions of the web 13.

The lens 59 is or can be identical with the lens 48 which is shown in FIG. 2, i.e., the intensity profile of the beam 56*a* being focussed upon the advancing laminate at the periphery of the conveyor 19 corresponds to that shown in FIG. 5.

The width of the gap 66 shown in FIG. 4 as a result of the making of the cuts 61 across the advancing laminate has been exaggerated for the sake of clarity. The reference characters 67 denote those marginal portions of the uniting bands 62 which are coated with inactivated adhesive for the reasons explained in connection with the making of inactivated annular portions 54 surrounding the perforations 51. Each uniting band 62 is provided with a pair of parallel straight inactivated zones 67; this is of advantage because the rolling operation (at 22, 23 in the machine of FIG. 1) is less likely to entail expulsion (squeezing out) of adhesive to the external surface of a freshly formed annular envelope (convoluted uniting band 62). The thus expelled adhesive would affect the appearance of the filter cigarette and would be likely to cause neighboring filter cigarettes in a packet to adhere to each other. Moreover, such expelled adhesive could contaminate the conveyors which transport the filter cigarettes from the rolling or convoluting means 22, 23 to storage or to a packing machine.

The strip-shaped inactivated portions 67 can constitute web portions which are devoid of adhesive (as a result of the action of coherent radiation) or web portions which are coated with films of inactivated adhesive.

The apparatus which embodies the cutting unit 37 and the perforating unit 38 exhibits the advantage that one of these units can be detached from the frame of the filter tipping machine while the other unit remains in the fully installed position. Furthermore, the apparatus can be furnished with two or more units 37 and/or 38 which simplifies the conversion of the apparatus for the making of differently dimensioned and/or distributed perforations and/or for the making of longer or shorter uniting bands.

Figure 6:
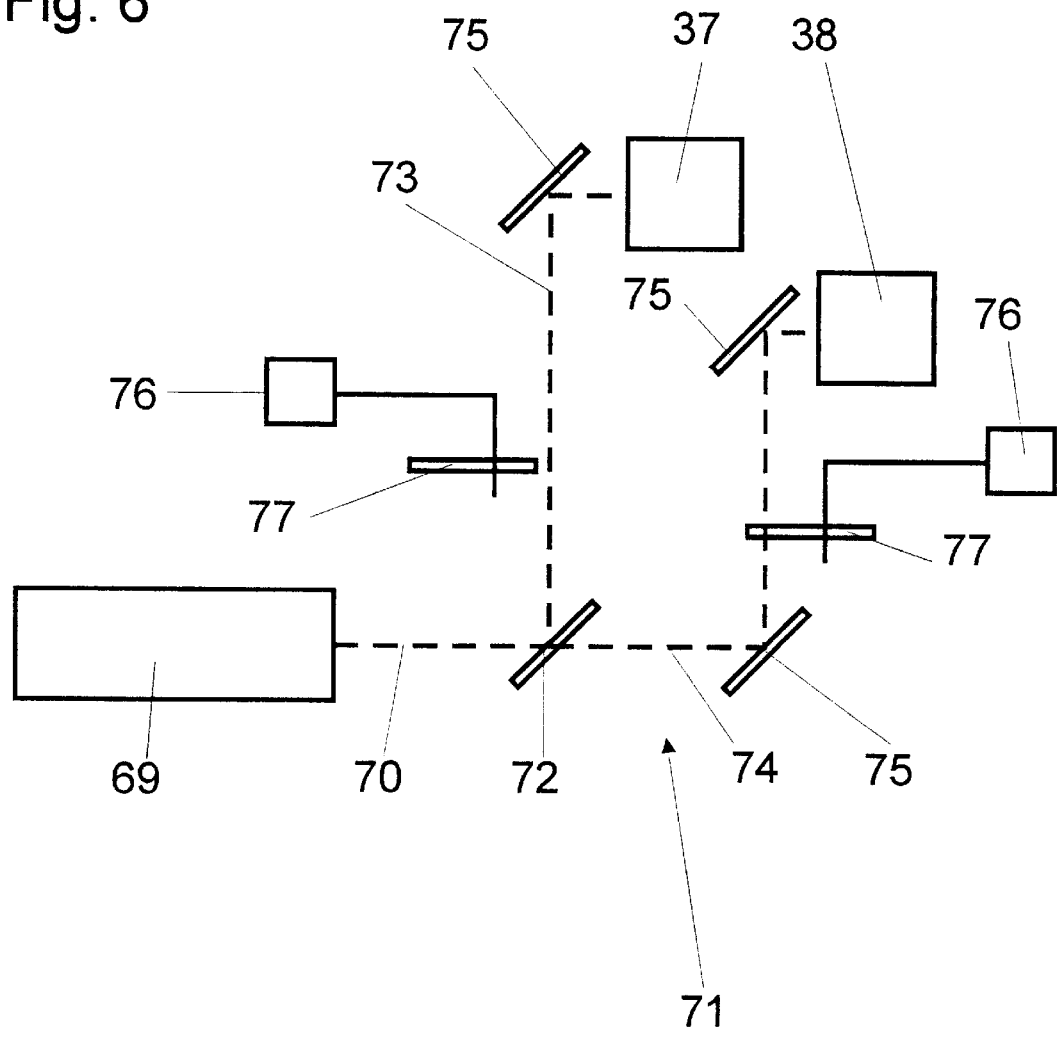
FIG. 6 is a diagrammatic view of a modified apparatus which employs a common source of coherent radiation for the severing and inactivating units.

FIG. 6 illustrates certain details of a modified apparatus wherein the severing means comprises a perforating unit 38 and a cutting unit 37. Furthermore, the modified apparatus comprises a single laser 69 which is designed to emit a high-intensity beam 70 of coherent radiation. This beam impinges on a beam spliter 71 including a partially transmitting mirror 72 serving to divide the beam 70 into partial beams 73 and 74. The beam 73 impinges upon a fully reflecting mirror 75 which directs this beam to the cutting unit 37 where the beam 73 performs the function of the beam 56 shown in FIG. 3. The beam 74 is deflected by two mirrors 75 and is thereupon put to use in connection with the making of one or more rows of perforations in the same way as the beam 43 of FIG. 2.

The laser 69 can constitute a continuous-wave laser which emits a continuous beam 70 of coherent radiation. If the partial beam 73 and/or 74 is to be converted into a pulsating beam, the apparatus of FIG. 6 is equipped with suitable shutter arrangement for the partial beam 73 and/or 74. FIG. 6 shows a pulsating means for the beam 73 including a shutter disc 77 and a motor 76 for the disc, as well as a pulsating means for the beam 74 including a second shutter disc 77 and a second motor 76 operatively connected with the second disc.

Lasers which can be put to use in the apparatus of the present invention are obtainable, for example, at the Firm LUMONICA GmbH, Junkers-Strasse 5, D-82178 Puchheim, Federal Republic Germany. For example each of the lasers 42, 42*a* can constitute an energy source of the type known as IMPACT 3000 (furnished by LUMONICS GmbH). IMPACT 3000 lasers are $CO_2$ lasers which are designed to emit pulsating high-energy beams of short duration.

Diffractive lenses of the type shown at 48 and 59 are obtainable, for example, at the Firm COHERENT, Inc., 2301 Lindbergh Street, Auburn, Calif. 95602 or at LASER COMPONENTS GmbH, Werner-von-Siemens-Strasse 15, D-82140 Olching, Federal Republic Germany. Optical arrangements of the type shown at 68 in FIG. 3 (called scanning modules) are available, for example, at the Firm GENERAL SCANNING GmbH, Maximilian Forum, Lochhamerstrasse 11, D-82152 Martinsried, Federal Republic Germany.

In additional to the numerous aforementioned advantages, the improved method and apparatus exhibit the advantage that, if the inactivating means relies on one or more beams of coherent radiation, the inactivating operation can be completed within extremely short intervals of time with a heretofore unknown degree of accuracy and reproducibility. Moreover, the number, the sizes and the locations of the inactivated portions of the adhesive films forming part of the uniting bands (such as 62) are practically unlimited.

Furthermore, and as shown in FIGS. 2, 3 and 6, each severing operation can be carried out simultaneously with the appurtenant inactivating operation and the inactivating means can employ one or more component parts of the associated severing (cutting or perforating) means. This contributes to a shortening of intervals which are required to carry out the severing and/or the inactivating operations. Thus, it is not necessary to reduce the speed of lengthwise movement of the laminate for the sole purpose of ensuring the completion of a satisfactory severing or inactivating operation.

Another important advantage of the improved method and apparatus is that, due to the utilization of coherent radiation for the establishment of desirable inactivated zones of the adhesive film, the inactivating operation is independent of the format of the filter cigarettes and/or of the nature of the material of the uniting bands. This renders it possible to shorten the intervals of idleness of the tipping machine during conversion for the making of different types of filter cigarettes. In fact, even if a change of the filter cigarette format necessitates certain changes in the dimensions and/or distribution of inactivated zones, the corresponding (cutting and/or perforating) unit can be altered or adapted with little loss in time.

Last but not least, the utilization of a common laser beam for the cutting and/or perforating as well as for the building of inactivated previously adhesive zones renders it possible to establish the inactivated (non-adhesive) zones in optimum positions relative to the respective cuts and/or perforations. This even further enhances the reliability of the method and apparatus and renders it possible to turn out high-quality products which are highly unlikely to be contaminated by displaced adhesive and which are designed to permit the inflow of atmospheric air into the column of tobacco smoke in a highly predictable and reliable manner.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of treating webs of tipping paper and other wrapping material and, therefore, such adaptations should and are intended to be comprehended within the meaning and range of equivalence of the appended claims.

What is claimed is:

1. A method of treating a laminate including a web having a first side and a second side, and a film of an inactivatable adhesive at least partially coating at least one side of the web, comprising the steps of:

severing at least one first portion of the laminate; and inactivating a portion of the inactivatable adhesive, the portion of the inactivatable adhesive forming part of at least one second portion of the laminate adjacent to the severed first portion, wherein the laminate is a strip consisting of coherent successive uniting bands adapted to attach rod sections of filter material for tobacco smoke to rod tobacco-containing products in a filter tipping machine.

2. The method of claim 1, wherein said film coats at least a major portion of said at least one side of the web.

3. The method of claim 1, further comprising the step of advancing the laminate in a predetermined direction along a predetermined path, said severing step comprising repeatedly cutting across the advancing web in a predetermined portion of said path to thus separate successive uniting bands from the advancing laminate.

4. The method of claim 3, wherein said adhesive is inactivatable in response to exposure to coherent radiation and said cutting step comprises establishing a source of coherent radiation and directing at least one first beam of coherent radiation from said source against longitudinally spaced-apart transversely extending regions of laminate in said predetermined portion of said path to thus separate said successive uniting bands from the advancing laminate, said inactivating step including directing at least one beam of coherent radiation from said source against the adhesive film adjacent said transversely extending regions.

5. The method of claim 4, wherein each uniting band has two marginal sections of inactivated adhesive.

6. A method of treating a laminate including a web having a first side and a second side, and a film of an inactivatable adhesive at least partially coating at least one side of the web, comprising the steps of:

providing the web with a plurality of perforations, each perforation corresponding to a first portion of the laminate and being surrounded by inactivatable adhesive; and inactivating a portion of the inactivatable adhesive, the portion of the inactivatable adhesive forming part of at least one second portion of the laminate adjacent to the perforated first portion, said inactivatable step including inactivating the adhesive around at least some of the perforations.

7. The method of claim 6, wherein the adhesive is inactivatable in response to exposure to coherent radiation and said providing step includes establishing a source of coherent radiation and repeatedly directing at least one first portion of a beam of radiation issuing from said source against selected sections of the at least one first portion of the laminate to thus provide said perforations, said inactivating step including simultaneously directing at least one second portion of the at least one beam against the adhesive surrounding at least some of the perforations so that said at least some perforations are surrounded by regions of inactivated adhesive.

8. A method of treating a laminate including a web having a first side and a second side, and a film of an inactivatable adhesive at least partially coating at least one side of the web, comprising the steps of:

severing at least one first portion of the laminate; and inactivating a portion of the inactivatable adhesive, the portion of the inactivatable adhesive forming part of at least one second portion of the laminate adjacent to the severed first portion, wherein the adhesive is inactivatable in response to coherent radiation, said inactivating step comprising subjecting the portion of the adhesive forming part of at least one second portion of the laminate to the action of said radiation.

9. A method of treating a laminate including a web having a first side and a second side, and a film of an inactivatable adhesive at least partially coating at least one side of the web, comprising the steps of:

severing at least one first portion of the laminate; and inactivating a portion of the inactivatable adhesive, the portion of the inactivatable adhesive forming part of at least one second portion of the laminate adjacent to the severed first portion, wherein the adhesive contains a solvent which is evaporable in response to the action of coherent radiation to thus inactivate the corresponding part of the film, said inactivating step including subjecting the solvent in the portion of the adhesive forming part of said at least one second portion of the laminate to the action of coherent radiation.

10. A method of treating a laminate including a web having a first side and a second side, and a film of an inactivatable adhesive at least partially coating at least one side of the web, comprising the steps of:

severing at least one first portion of the laminate; and inactivating a portion of the inactivatable adhesive, the portion of the inactivatable adhesive forming part of at least one second portion of the laminate adjacent to the severed first portion, wherein said adhesive is inactivatable in response to exposure to coherent radiation and said severing step comprises establishing a source of coherent radiation, directing from said source a first portion of at least one beam of coherent radiation against predetermined sections of said at least one first portion of the laminate to thus provide the laminate with a plurality of perforations, each of which is surrounded by adhesive, as well as with a plurality of elongated cuts dividing the laminate into a plurality of discrete bands, said inactivating step comprising directing a second portion of said at least one beam against the adhesive surrounding the perforations so that the perforations are surrounded by inactivated adhesive.

11. An apparatus for treating a laminate including a web having a first side and a second side, and a film of inactivatable adhesive at least partially coating at least one side of the web, comprising:

means for severing at least one area of the laminate; and means for inactivating at least a portion of the inactivatable adhesive film adjacent to said at least one area of the laminate, wherein at least one of said severing and inactivating means includes at least one source of coherent radiation, and means for directing at least one beam of coherent radiation from said at least one source against the laminate, said means for directing including a diffractive optical element arranged to direct a higher-intensity portion of the at least one beam against the laminate to thus sever the laminate, and to direct a lower-intensity portion of the at least one beam against the film of adhesive.

12. The apparatus of claim 11, wherein the higher-intensity portion of the at least one beam takes up approximately one-third of the cross-sectional area of the beam.

13. The apparatus of claim 11, wherein the higher-intensity portion of the at least one beam is surrounded by the lower-intensity portion.

14. The apparatus of claim 13, wherein the intensity of said higher-intensity portion of said at least one beam at least approximates about 90% of total intensity of the beam.

* * * * *